US010226876B2

(12) United States Patent
Borski

(10) Patent No.: US 10,226,876 B2
(45) Date of Patent: Mar. 12, 2019

(54) DUAL SLICE BREAD MACHINE

(71) Applicant: James Borski, Stevens Point, WI (US)

(72) Inventor: James Borski, Stevens Point, WI (US)

( * ) Notice: Subject to any disclaimer, the term of this patent is extended or adjusted under 35 U.S.C. 154(b) by 0 days.

(21) Appl. No.: 15/272,299

(22) Filed: Sep. 21, 2016

(65) Prior Publication Data

US 2017/0080589 A1 Mar. 23, 2017

Related U.S. Application Data

(60) Provisional application No. 62/221,401, filed on Sep. 21, 2015.

(51) Int. Cl.

| | |
|---|---|
| ***B26D 3/28*** | (2006.01) |
| ***B26D 7/06*** | (2006.01) |
| ***B26D 1/11*** | (2006.01) |
| ***B26F 1/18*** | (2006.01) |

(52) U.S. Cl.

CPC ..... *B26D 3/28* (2013.01); *B26D 1/11* (2013.01); *B26D 7/0625* (2013.01); *B26F 1/18* (2013.01)

(58) Field of Classification Search

CPC ... B26D 3/28; B26D 3/30; B26D 1/11; B26D 1/18; B26D 3/281; B26D 3/282; B26D 3/283

See application file for complete search history.

(56) References Cited

U.S. PATENT DOCUMENTS

| | | | | | |
|---|---|---|---|---|---|
| 1,515,014 | A | * | 11/1924 | Downs | B26B 29/063 83/468.2 |
| 1,867,377 | A | | 7/1932 | Rohwedder | |
| 2,247,692 | A | | 7/1941 | Papendick | |
| 3,987,948 | A | * | 10/1976 | Peters | B26D 3/30 225/97 |
| 4,557,019 | A | * | 12/1985 | Van Devanter | A22C 25/18 452/157 |
| 4,581,971 | A | | 4/1986 | Hickman et al. | |
| 4,750,413 | A | * | 6/1988 | Voegtlin | A21C 7/01 425/332 |
| 4,868,951 | A | * | 9/1989 | Akesson | A22C 25/12 452/155 |
| 4,960,021 | A | * | 10/1990 | Carney | B26D 1/22 83/120 |
| 4,964,323 | A | | 10/1990 | Fortney | |

(Continued)

*Primary Examiner* — Jason Daniel Prone
*Assistant Examiner* — Richard D Crosby, Jr.
(74) *Attorney, Agent, or Firm* — Global Intellectual Property Agency, LLC; Daniel Boudwin

(57) ABSTRACT

A dual slice bread machine for cutting slits into loaves of bread perpendicular to a conventional bread slice. The present system has an actuating rack having a series of regularly spaced piercing knives mounted thereon. The actuating rack is configured to be raised and lowered automatically. In use, a loaf of bread is placed underneath the actuating rack. When the actuating rack is lowered, the knives puncture the loaf, creating a series of vertical slits along the length of the loaf. The loaf is then cut with a conventional bread slicing machine where the slices alternate between a slice that dissects a vertical slit and a cut that is positioned exactly in between two adjacent vertical slits. This creates a loaf with slices having a centered living hinge capable of being easily folded and separated into equal halves.

18 Claims, 6 Drawing Sheets

(56) References Cited

U.S. PATENT DOCUMENTS

| | | | | | |
|---|---|---|---|---|---|
| 5,095,791 | A * | 3/1992 | Jongerius | B26D 1/50 | 83/155 |
| 5,375,509 | A * | 12/1994 | Taylor | A21C 11/00 | 425/307 |
| D354,659 | S * | 1/1995 | Dornbush | D7/673 | |
| 5,461,956 | A * | 10/1995 | Petersen | B26D 1/16 | 83/221 |
| 5,985,029 | A * | 11/1999 | Purcell | B65G 15/62 | 118/324 |
| D545,615 | S * | 7/2007 | Lin | D7/381 | |
| 7,428,858 | B2 * | 9/2008 | Owens | B23D 47/045 | 144/245.2 |
| 7,987,757 | B2 | 8/2011 | Willett | | |
| 8,474,357 | B2 * | 7/2013 | Stanojevic | B26D 1/553 | 414/749.1 |
| 8,479,623 | B2 * | 7/2013 | Bridges | A22C 17/0033 | 83/13 |
| 9,636,831 | B1 * | 5/2017 | Furia | B26B 29/063 | |
| 2006/0075859 | A1 * | 4/2006 | Willett | B26D 1/553 | 83/13 |
| 2008/0257123 | A1 * | 10/2008 | Williams | B26D 1/15 | 83/409 |
| 2011/0265621 | A1 * | 11/2011 | Schmidt | B26D 1/03 | 83/35 |
| 2012/0085216 | A1 * | 4/2012 | Lobbia | B26D 1/06 | 83/821 |
| 2012/0247302 | A1 * | 10/2012 | Cronin | B26D 3/08 | 83/883 |
| 2014/0260853 | A1 * | 9/2014 | Grasselli | B26D 1/45 | 83/76.1 |
| 2017/0080589 | A1 * | 3/2017 | Borski | B26D 3/28 | |
| 2017/0238594 | A1 * | 8/2017 | Turatti | B26D 3/30 | |

* cited by examiner

DUAL SLICE BREAD MACHINE

CROSS REFERENCE TO RELATED APPLICATIONS

This application claims the benefit of U.S. Provisional Application No. 62/221,401 filed on Sep. 21, 2015. The above identified patent application is herein incorporated by reference in its entirety to provide continuity of disclosure.

BACKGROUND OF THE INVENTION

The present invention relates to bread cutting machines. More specifically, the present invention relates to bread cutting machines that are configured to cut multiple vertical slits along the length of a loaf of bread perpendicular to the direction of a conventional bread slicing machine to create a living hinge on each slice of bread.

Bread is a staple food of a modern diet, offering significant nutritional value in an economical and convenient form. Bread can be made from a variety of grains and prepared in multiple ways, but a common method of incorporating it into a meal is to make a sandwich by placing a food such as a protein or a vegetable between two slices of bread. Because sandwiches are popular meals, many consumers prefer to purchase loaves of bread that have been precut into slices. The slicing is often done by a conventional bread slicing machine that is designed to create many parallel slices along the length of a loaf of bread, each with a substantially equal thickness.

While two slices of bread are often used to make a sandwich, many people prefer to make a sandwich out of a single slice of bread. For example, if someone is on a diet to minimize carbohydrate intake, a sandwich made from a single slice of bread may be desired over a sandwich made from two slices of bread. Additionally, children and the elderly may require less daily caloric intake and may only desire to eat a single slice of bread. However, the convenience of pre-sliced bread is minimized when each slice of bread must be recut to create a single slice sandwich. Therefore, there is a need for an automated device that can create an additional cut in each slice of bread to facilitate making a single slice sandwich.

SUMMARY OF THE INVENTION

In view of the foregoing disadvantages inherent in the known types of bread slicing machines now present in the prior art, the present invention provides a dual slice bread machine wherein the same can be utilized for providing convenience for the user when slicing a loaf of bread with dual perpendicular cuts. The present system comprises a bread cutting assembly and a conveyor system. The bread cutting assembly further comprises an actuating rack having a series of regularly spaced knives mounted thereon. The actuating rack is configured to be raised and lowered automatically. In use, a loaf of bread is placed underneath the actuating rack. When the actuating rack is lowered the knives puncture the loaf, creating a series of vertical slits along the length of the loaf. The loaf is then cut with a conventional bread slicing machine where the slices alternate between a cut that dissects a vertical slit and a cut that is positioned exactly in between two vertical slits. This creates a loaf with slices having a living hinge capable of being easily folded and separated. In some embodiments of the dual slice bread machine, the bread cutting assembly is mounted onto a conveyor assembly that automatically feeds loaves into position below the actuating rack. Further embodiments have a conventional bread slicer mounted to the conveyor system as well, wherein a loaf is moved automatically and is first punctured with the knives of the actuating rack and then sliced with the conventional bread slicing machine.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
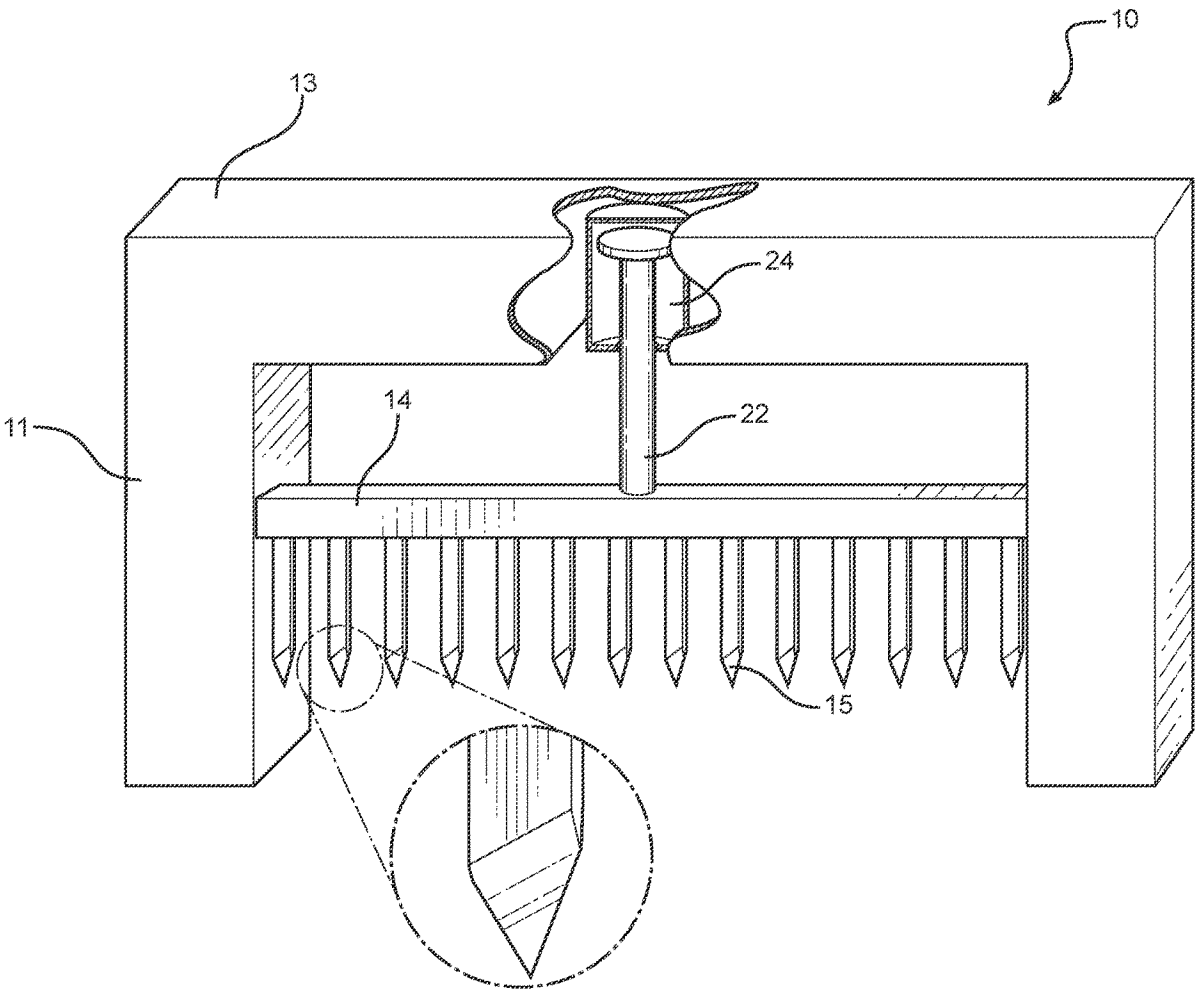
FIG. 1 shows a perspective view of an embodiment of the actuating rack of the bread cutting assembly with the knives retracted.

Reference is made herein to the attached drawings. Like reference numerals are used throughout the drawings to depict like or similar elements of the dual slice bread machine. The figures are intended for representative purposes only and should not be considered to be limiting in any respect.

Figure 2:
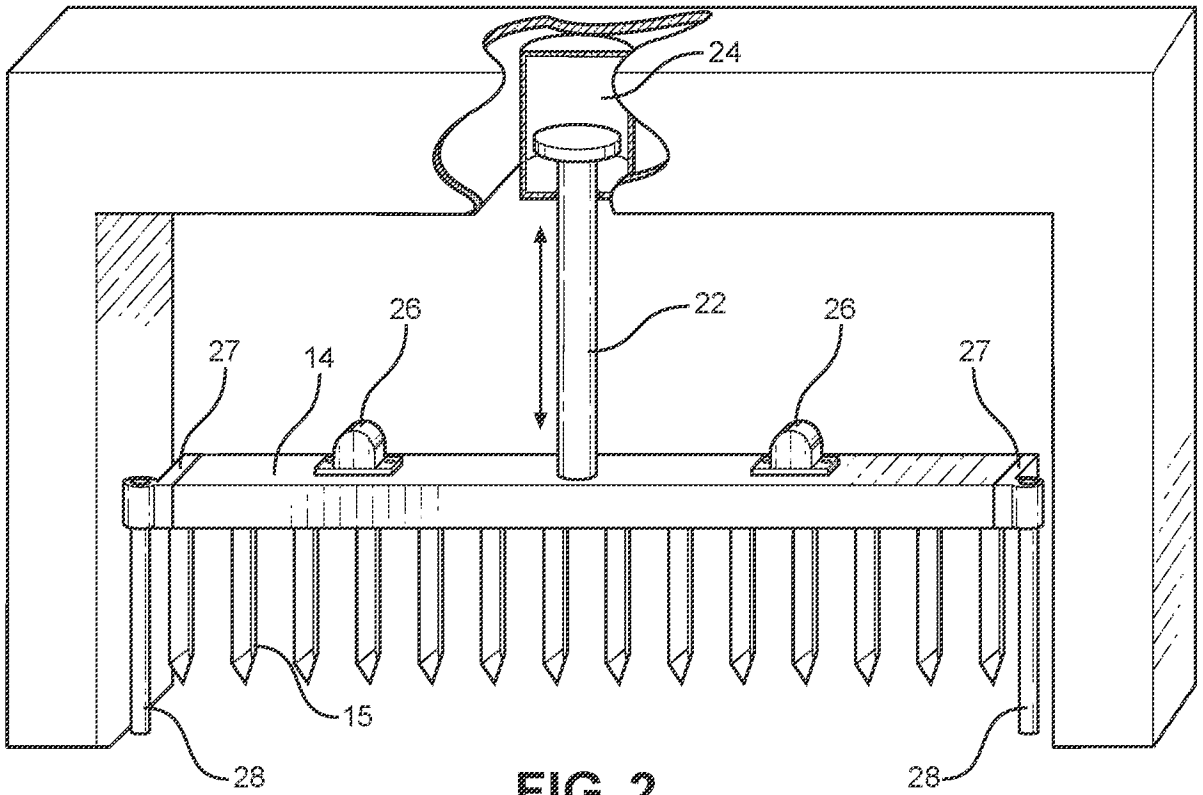
FIG. 2 shows a perspective view of an embodiment of the actuating rack of the bread cutting assembly with the knives extended.

Referring now to FIGS. 1-2, there are shown perspective views of the actuating rack of the bread cutting assembly. The bread cutting assembly 10 comprises an actuating rack 14 and a plurality of knives 15 attached thereto, wherein the plurality of knives are spaced apart at regular intervals. In the illustrated embodiment, each blade 15 is tapered toward a point on the distal end thereof. The tapered end creates a sharp point for easily piercing the bread. The wider portion of the blade, towards the proximal end, provides the shape of the vertical slit. In some embodiments of the bread cutting assembly, the actuating rack 14 is mounted onto a support frame comprising a top member 13 and two parallel side members 11 extending perpendicularly from the distal ends thereof. The distance between the parallel side members 11 is larger than the length of a conventional loaf of bread. The actuating rack 14 is connected to the top member 13 of the support frame via a moveable assembly. In alternate embodiments of the dual slice bread machine, the actuating member 14 is mounted along a linear vertical track 28 via a bracket 27 and disposed adjacent to the parallel side members 11. The moveable assembly is configured to extend and retract the actuated rack 14 between a lowered position and a raised position. In one embodiment of the dual slice bread machine, the moveable assembly comprises a piston 24 and an arm 22 secured to the top element 13 of the support structure, wherein the arm 22 is configured to extend and retract the actuating rack 14. In some embodiments of the bread cutting assembly, the piston 24 is pneumatically powered.

The plurality of knives 15 are vertically mounted to the actuating rack 14 at regular intervals. The width of the knives 15 runs parallel to the longitudinal axis of the actuating rack 14, such that the width of each blade lie along a singular plane. In use, a loaf of bread is positioned directly beneath the knives 15 of the actuating rack 14. The knives 15 are lowered by the moveable assembly and penetrate the loaf of bread, creating a series of vertical slits along a longitudinal axis of the bread. The bread is subsequently sliced with a conventional bread slicing machine, wherein the knives of the conventional bread slicing machine are configured to create a series of two cuts. A first cut slices directly through the center of the vertical slit created by the bread cutting assembly and a second cut slices through the middle of the uncut portion of the bread, equidistant to each neighboring vertical slit. This results in slices with cuts running through half the thickness of each slice of bread wherein the other half of the thickness of the slice remains uncut, creating a slice of bread having a living hinge down the center of the slice, capable of being easily folded and separated, if desired.

In some embodiments of the dual slice bread machine, there is a vibrating mechanism 26 disposed on the actuating rack 14 configured to move the plurality of knives 15 in an oscillating motion. The oscillating motion is configured to assist an initial penetration of knives 15 into the top of a loaf of bread when creating the vertical slits. Additionally, the oscillating motion helps release the knives 15 from the loaf of bread once a cut is complete. In one embodiment of the vibrating mechanism, the oscillating motion is a 1/16" side to side motion.

Figure 3:
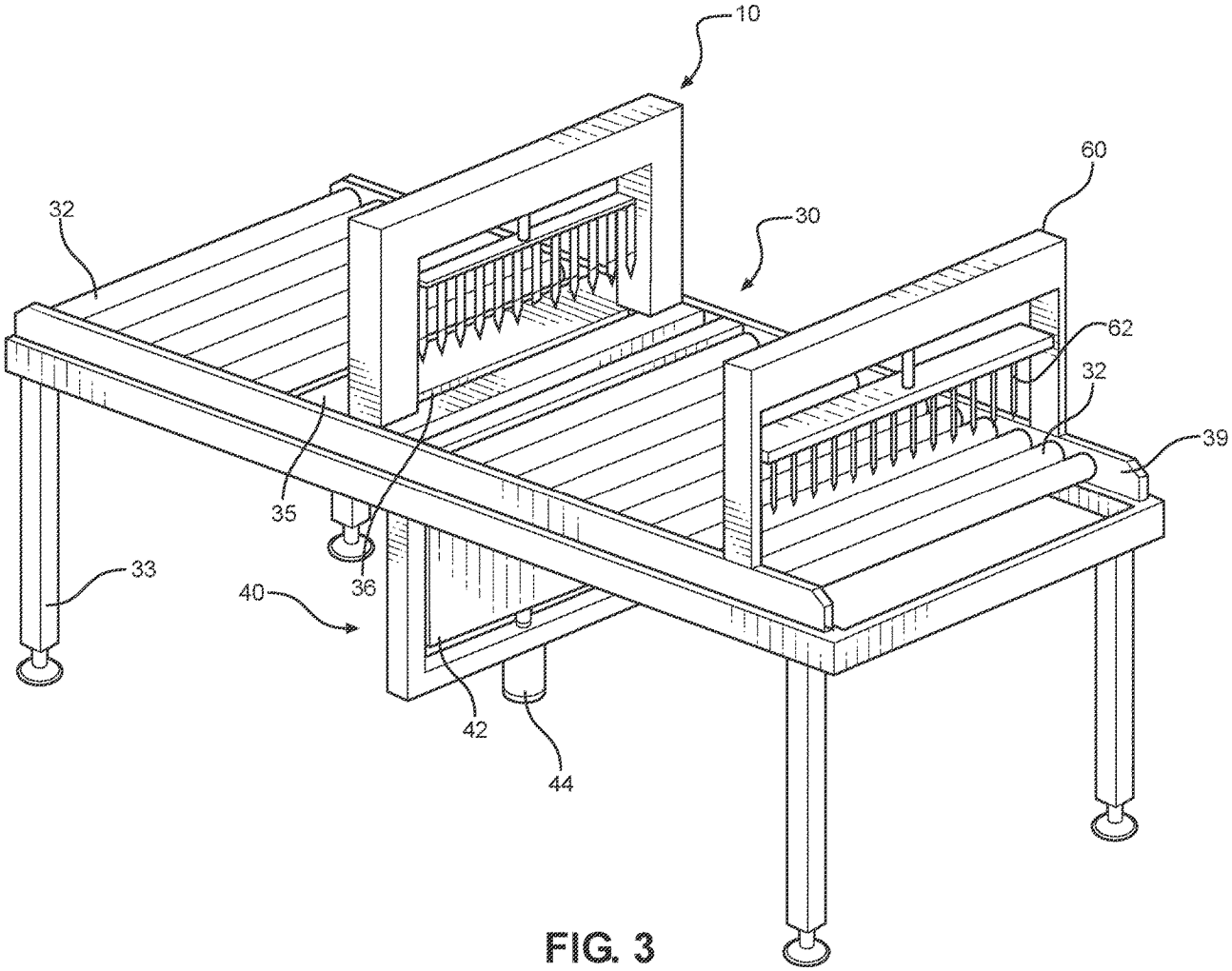
FIG. 3 shows a perspective view of an embodiment of the bread cutting assembly mounted onto a conveyor with a stop element in a retracted position.
Figure 4:
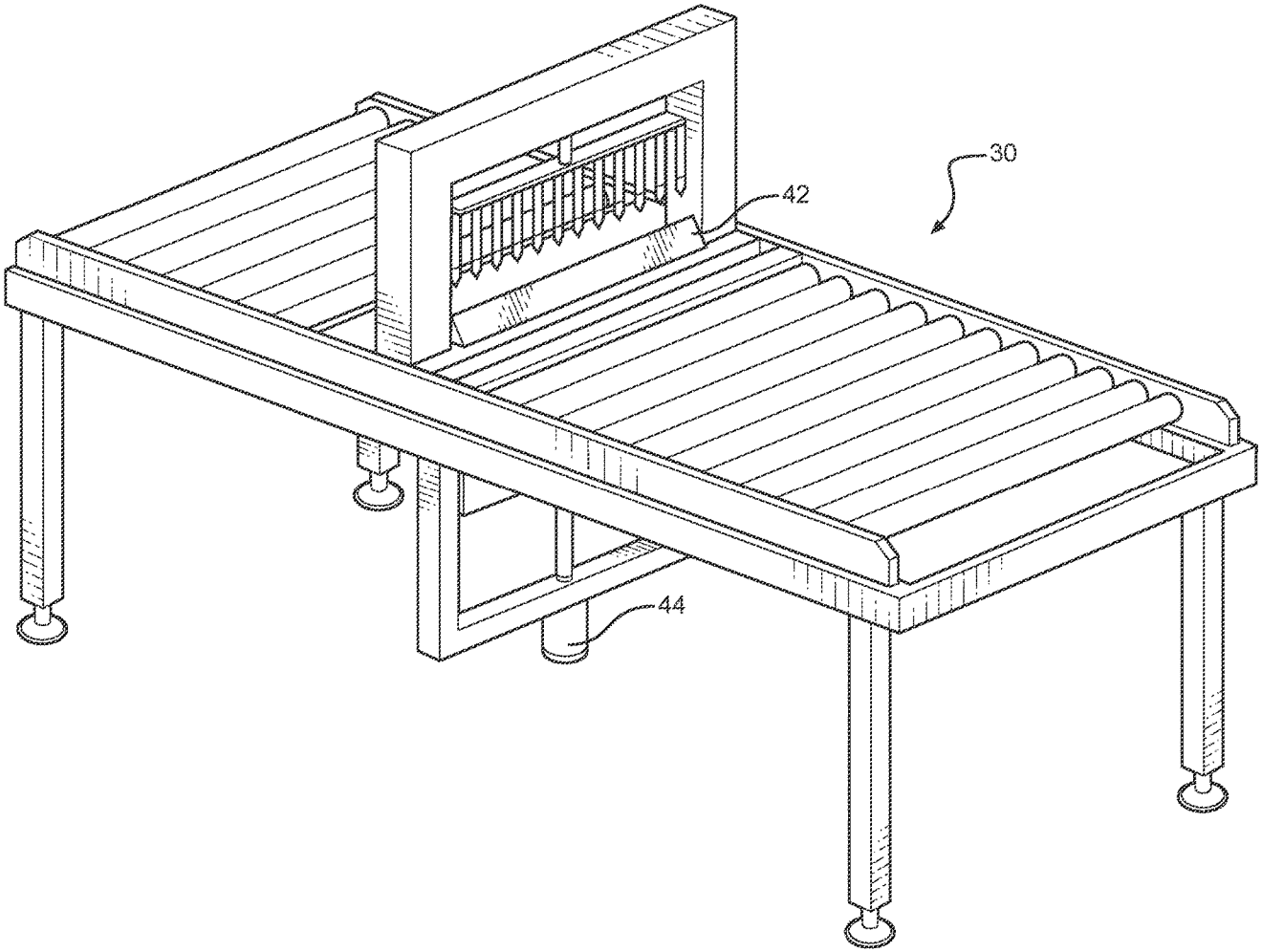
FIG. 4 shows a perspective view of an embodiment of the bread cutting assembly mounted onto a conveyor with a stop element in an extended position.

Referring now to FIGS. 3 and 4, there are shown perspective views of the bread cutting assembly installed within a conveyor assembly. The conveyor assembly 30 comprises a series of rollers 32 mounted onto two parallel tracks 33 that are held up by support legs 39. In some embodiments of the conveyor assembly 30, the rollers 32 can be individually power driven and configured to move loaves of bread toward the bread cutting assembly 10 at a predetermined speed to ensure efficient and accurate puncturing of each loaf of bread.

In some embodiments of the dual slice bread machine, a loaf stop 40 is mounted to the conveyor assembly 30 below the bread cutting assembly 10. The loaf stop 40 comprises a plate 42 secured to an actuating mechanism 44 configure to move the plate 42 between a lowered position shown in FIG. 3 and a raised position shown in FIG. 4. Once the loaves of bread have been loaded onto the conveyor system 30, the actuating mechanism 44 raises the plate from below the bread cutting assembly 10, stopping the advancement the bread loaves and positioning the middle of a bread loaf to be located directly underneath the knives 15 of the bread cutting assembly 30. The actuating mechanism 44 can be activated via a sensor or a timer to ensure that the plate 42 is raised at the exact time to stop a loaf of bread without damaging it. In some embodiments, the actuating mechanism 44 for the loaf stop 40 is pneumatically powered.

The knives 15 are lowered by the movable assembly and puncture the loaf, creating the vertical slits. Some embodiments of the dual slice bread machine incorporate a conventional bread slicing machine 60 that can be mounted onto the conveyor assembly following the bread cutting assembly. The conventional bread slicing machine comprises a plurality of blades that are positioned perpendicular to the longitudinal axis of a loaf of bread. The bread cutting assembly is disposed along the conveyer anteriorly relative to the plurality of blades. Further, the width of each of the plurality of knives is equal to a distance between each of the plurality of blades. As such, the spacing for the slicing knives 62 of the conventional bread slicer is positioned to ensure that the conventional slicing alternates between dissecting the middle of each vertical slit created by the bread cutting assembly and slicing exactly in between each vertical slit.

Figure 5A:
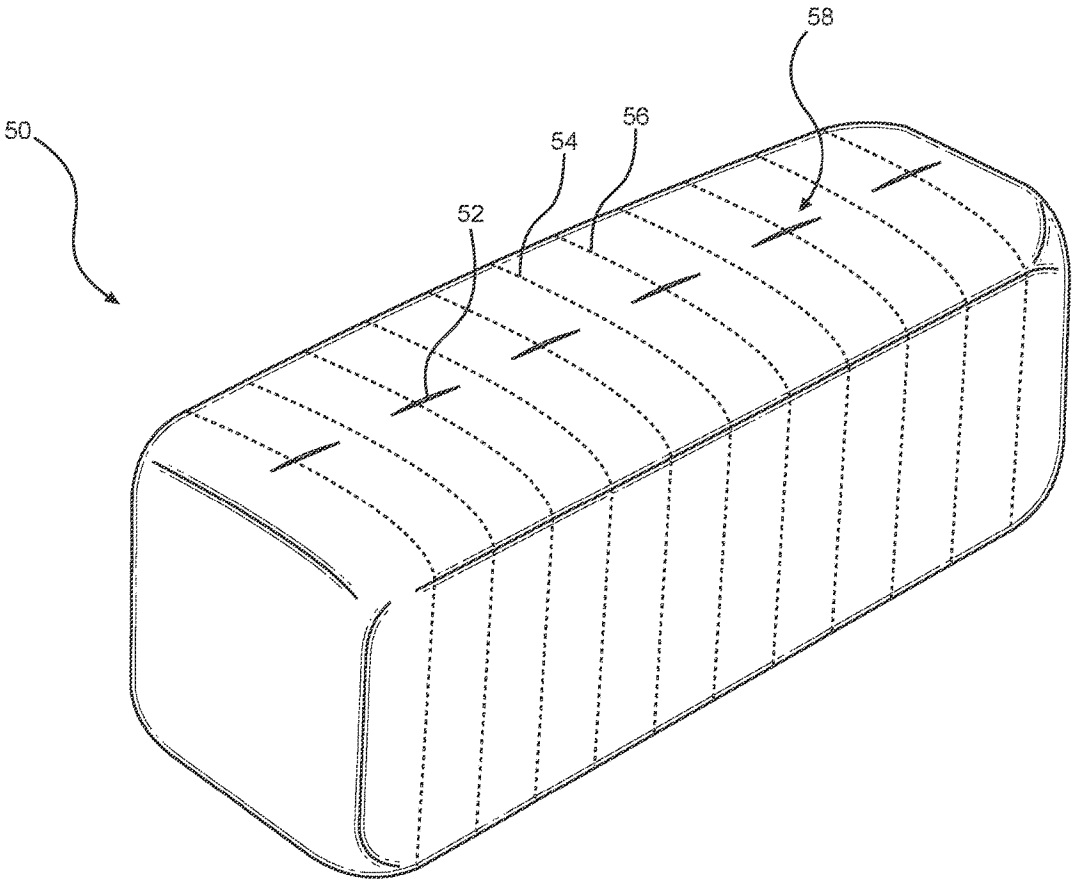
FIG. 5A shows a perspective view of a loaf of bread with perpendicular cuts created by the bread cutting assembly and a conventional bread slicing machine.
Figure 5B:
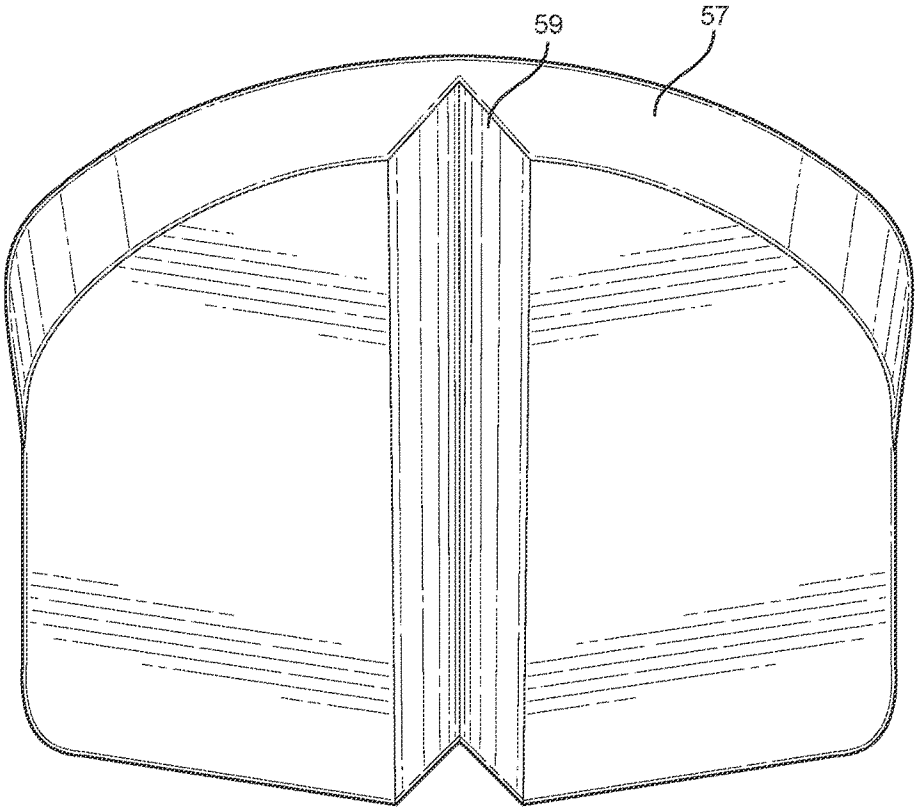
FIG. 5B shows a perspective view of a slice of bread having a living hinge cut thereon.

Referring now to FIGS. 5A and 5B, there are shown perspective views of a loaf of bread with perpendicular cuts creates by the bread cutting assembly and a conventional bread slicing machine, and a single slice of bread with a living hinge, respectively. After the loaf 50 is punctured with the dual slice bread machine, creating a series of vertical slits 52, it can then be cut with a conventional bread slicing machine. The spacing of the slices from the conventional bread slicing machine are configured to ensure that cuts alternate between a first cut 54 that is positioned exactly in between two vertical slits 52 and a second cut that dissects 56 a vertical slit 58. This ensures that each slice of bread 57 has a notch extending exactly halfway through its thickness. This cut creates a living hinge 59 within the bread slice 57, allowing for an easily folded slice of bread. Additionally, the slice of bread 57 can be easily separated in two along the living hinge 59, should a user wish to separate the two parts of the slice.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bread cutting assembly comprising:

an actuating rack wherein the actuating rack is vertically movable between a raised position and a lowered position;

a plurality of knives affixed to the actuating rack at regular intervals therealong;

wherein the width of each of the plurality of knives lies along a singular plane;

a conveyor affixed to the actuating rack, wherein the conveyor is configured to deliver a loaf of bread along an axis perpendicular to that of the plurality of knives;

a stopping plate disposed parallel to the singular plane of the plurality of knives;

wherein the stopping plate is configured to selectively move between a raised position and a lowered position;

wherein the raised position, the stopping plate extends through the conveyor posterior to the actuating rack; and wherein the raised position, the stopping plate is configured to position the loaf of bread beneath the plurality of knives such that a midline disposed along a longitudinal axis of the loaf of bread is positioned along the singular plane of the plurality of knives.

2. The bread cutting assembly of claim 1, further comprising a vibrating mechanism mounted onto the actuating rack, configured to create oscillating motion in the plurality of knives.

3. The bread cutting assembly of claim 1, wherein the conveyor is a roller conveyor assembly.

4. The bread cutting assembly of claim 1, wherein the actuating rack further comprises a piston and a pneumatic arm.

5. The bread cutting assembly of claim 1, further comprising a linear vertical track, wherein the actuating rack moves along said linear vertical rack.

6. The bread cutting assembly of claim 1, wherein each of the plurality of knives taper to a point at a distal end thereof.

7. The bread cutting assembly of claim 1, wherein each of the plurality of knives taper inwardly from a front side thereof and a rear side thereof such that a sharpened edge is formed on opposing sides of each of the plurality of knives.

8. The bread cutting assembly of claim 1, wherein the actuated rack is configured to move from the raised position to the lowered position when a sensor detects the loaf of bread positioned below the plurality of knives.

9. The bread cutting assembly of claim 1, wherein the actuated rack is configured to move from the raised position to the lowered position at a set interval of time.

10. A bread cutting assembly comprising:

an actuating rack wherein the actuating rack is vertically movable between a raised position and a lowered position;

a plurality of knives affixed to the actuating rack at regular intervals therealong;

wherein the width of each of the plurality of knives lies along a singular plane;

a conveyor affixed to the actuating rack, wherein the conveyor is configured to deliver a loaf of bread along an axis perpendicular to that of the plurality of knives;

a stopping plate disposed parallel to the singular plane of the plurality of knives;

wherein the stopping plate is configured to selectively move between a raised position and a lowered position;

wherein the raised position, the stopping plate extends through the conveyor posterior to the actuating rack;

wherein the raised position, the stopping plate is configured to position the loaf of bread beneath the plurality of knives such that a midline disposed along a longitudinal axis of the loaf of bread is positioned along the singular plane of the plurality of knives;

a plurality of blades;

the plurality of knives disposed along the conveyor anteriorly relative to the plurality of blades, wherein a width of each of the plurality of knives is equal to a distance between each of the plurality of blades;

the width of each of the plurality of knives is positioned perpendicularly to a width of each of the plurality of blades;

a plane of the cutting surface of each of the plurality of blades bisects a plane of the cutting surface of the plurality of knives;

wherein the plurality of blades are configured to cut the loaf of bread into a plurality of slices, wherein each slice of the plurality of slices comprises a living hinge created by the plurality of knives.

11. The bread cutting assembly of claim 10, further comprising a vibrating mechanism mounted onto the actuating rack, configured to create oscillating motion in the plurality of knives.

12. The bread cutting assembly of claim 10, wherein the conveyor is a roller conveyor assembly.

13. The bread cutting assembly of claim 10, wherein the actuating rack further comprises a piston and a pneumatic arm.

14. The bread cutting assembly of claim 10, further comprising a linear vertical track, wherein the actuating rack moves along said linear vertical track.

15. The bread cutting assembly of claim 10, wherein each of the plurality of knives taper to a point at a distal end thereof.

16. The bread cutting assembly of claim 10, wherein each of the plurality of knives taper inwardly from a front side thereof and a rear side thereof such that a sharpened edge is formed on opposing sides of each of the plurality of knives.

17. The bread cutting assembly of claim 10, wherein the actuated rack is configured to move from the raised position to the lowered position when a sensor detects the loaf of bread positioned below the plurality of knives.

18. The bread cutting assembly of claim 10, wherein the actuated rack is configured to move from the raised position to the lowered position at a set interval of time.

* * * * *